US005775659A

United States Patent [19]

Hartlaub et al.

[11] Patent Number: 5,775,659

[45] Date of Patent: Jul. 7, 1998

[54] COMPACT DISK DRINK COASTER

[76] Inventors: Thaddeus J. Hartlaub, 1726 N. Claremont Dr., Janesville, Wis. 53545; Donald J. Ersler, 725 Garvens Ave., Brookfield, Wis. 53005

[21] Appl. No.: 873,686

[22] Filed: Jun. 12, 1997

[51] Int. Cl.[6] ..... A47B 91/00

[52] U.S. Cl. ..... 248/346.11

[58] Field of Search ..... 248/346.11; 205/39.4; 40/324; D7/510

[56] References Cited

U.S. PATENT DOCUMENTS

| | | | |
|---|---|---|---|
| 1,981,627 | 11/1934 | Merriman | 248/346.11 |
| 3,257,092 | 6/1966 | Blundell | 248/346.11 |
| 3,515,262 | 6/1970 | Ornstein et al. | 40/324 X |
| 4,836,488 | 6/1989 | Ross | 248/346.11 |
| 4,858,872 | 8/1989 | Witt | 248/346.11 |

*Primary Examiner*—Ramon O. Ramirez
*Attorney, Agent, or Firm*—Donald J. Ersler

[57] ABSTRACT

A compact disc drink coaster includes a compact disc, and a protective backing. In a first preferred embodiment, the protective backing is fastened to the back of the compact disc. The large top surface of the compact disc may be easily printed with a design, name, slogan, or some other art work. In a second preferred embodiment, an edge spill ring may be placed around an outside circumference of the compact disc to prevent moisture from the top surface of the compact disc from spilling over the outside circumference thereof on to a resting surface. In a third preferred embodiment, an absorbent pad is fastened to the top surface of the compact disc to collect moisture from the bottom of a glass, can, or bottle. When the user is done with any of the compact disc drink coaster preferred embodiments, thereof may be placed in a compact disc jewel case which may be stored in a standard compact disc storage device.

14 Claims, 2 Drawing Sheets

COMPACT DISK DRINK COASTER

BACKGROUND OF THE INVENTION

1. Field of the Invention

The present invention relates generally to drink coasters and more specifically to a compact disc drink coaster which can be attractively styled, and fabricated from rejected, discarded, or scrap compact discs.

2. Discussion of the Prior Art

Every year, hundreds of millions of computer and audio compact discs are manufactured. Unfortunately, many of these compact discs are rejected because of imperfections and must be destroyed. Further, many compact discs are manufactured with software. This software eventually becomes obsolete, the compact discs will not be distributed and must be destroyed. Many individuals receive compact discs of sample software which they are not interested in using. These unwanted compact discs will also be discarded.

All these rejected compact discs create an environmental waste problem. At this time there is no viable way of completely recycling rejected compact discs. There is also a need for decreasing the dependency upon foreign crude oil. Crude oil is a material component of the plastic used in compact discs. Further, there is a need for drink coasters which protect the surface of furniture that are attractively styled and can be easily stored.

Accordingly, there is a clearly felt need in the art for a compact disc drink coaster which can be attractively styled, easily stored, serve as a method for recycling rejected compact discs, and decrease dependency upon foreign crude oil by using existing plastic material.

SUMMARY OF THE INVENTION

The primary objective of the present invention is to provide a compact disc drink coaster which can be attractively styled, easily stored, serve as a method for recycling rejected compact discs, and decrease dependency upon foreign crude oil by using existing plastic material. According to the present invention, a compact disc drink coaster includes a compact disc, and a protective backing. The protective backing can be fabricated from any material that will not scratch a resting surface such as rubber, or close cell foam. In a first preferred embodiment, a protective backing is fastened to the back surface of the compact disc. The protective backing is smaller in diameter than the compact disc and can be less than a sixteenth of inch thick. The large top surface of the compact disc may be easily printed with a design, name, slogan, or other art work. When the user is done with the compact disc drink coaster it may be placed in a compact disc jewel case which may be stored in a compact disc storage device.

In a second preferred embodiment, a small ring may be placed around the outside circumference of the compact disc or fastened to the top surface of the compact disc at the outside circumference. The protective backing of the first preferred embodiment is also fastened to the back of the compact disc. The large top surface of the compact disc may be easily printed with a design, name, slogan, or other art work. When the user is done with the compact disc drink coaster, it may be placed in a compact disc jewel case which may be stored in a standard compact disc storage device.

In a third preferred embodiment, an absorbent pad is fastened to the top surface of the compact disc to collect moisture from the bottom of a glass, can, or bottle. The absorbent pad is fabricated from any material which has highly absorbent properties such as x, y, or z. The diameter of the absorbent pad is such that some art work may be printed between an outside diameter of the absorbent pad and the outside circumference of the compact disc. The protective backing of the first preferred embodiment is also fastened to the back surface of the compact disc. When the user is done with the compact disc drink coaster it may be placed in a compact disc jewel case which may be stored in a standard compact disc storage device.

It is also possible to sell a kit to individuals which can be used to make their own compact disc drink coaster. This will allow an individual to recycle their own unwanted compact discs.

Accordingly, it is an object of the present invention to provide a compact disc drink coaster which provides a method for recycling rejected compact discs.

It is a further object of the present invention to provide a compact disc drink coaster which can be attractively styled.

It is yet a further object of the present invention to provide a compact disc drink coaster which may be easily stored in a compact disc storage device.

Finally, it is another object of the present invention to provide a compact disc drink coaster which decreases the dependency upon foreign oil by using existing plastic material.

These and additional objects, advantages, features and benefits of the present invention will become apparent from the following specification.

DETAILED DESCRIPTION OF THE PREFERRED EMBODIMENTS

Figure 1:
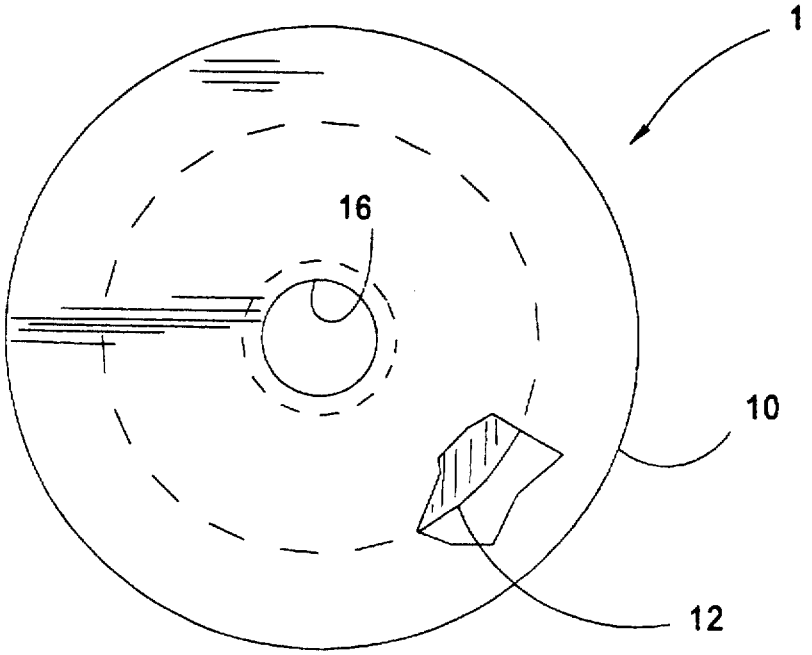
FIG. 1 is a top view of a first preferred embodiment of a compact disc drink coaster in accordance with the present invention.

With reference now to the drawings, and particularly to FIG. 1, there is shown a first preferred embodiment of a compact disc drink coaster 1. The compact disc drink coaster 1 includes a compact disc 10, and a protective backing 12.

The protective backing 12 is fastened to the back surface of the compact disk 10 and protects a resting surface from being scratched. The protective backing 12 can be fabricated from any material that will not scratch a resting surface such as rubber, or close cell foam. The protective backing 12 is smaller in diameter than the compact disc 10 and can be less than a sixteenth of inch thick. The large top surface of the compact disc 10 may be easily printed with a design, name, slogan, or other art work. When the user is done with the compact disc drink coaster 1 it may be placed in a compact disc jewel case which may be stored in a compact disc storage device.

Figure 2:
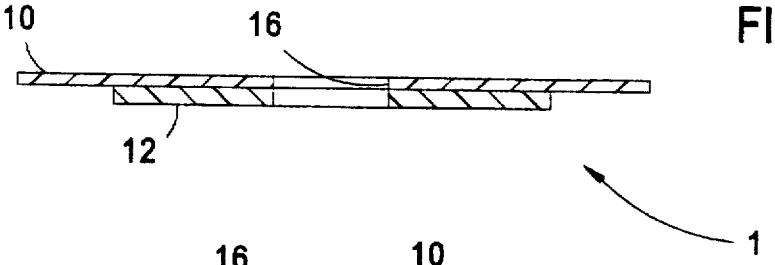
FIG. 2 is a cross sectional view of a first preferred embodiment of a compact disc drink holder in accordance with the present invention.
Figure 3:
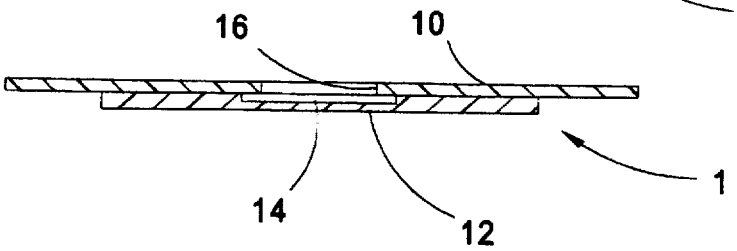
FIG. 3 is a cross sectional view of a first preferred embodiment of a compact disc drink coaster with a protective backing structured with a cavity in accordance with the present invention.

FIG. 2 shows a cross sectional view of the protective backing 12 fastened to the compact disc 10. In FIG. 3 a protective backing 12' has a cavity 14 which provides clearance for the spindle of a compact disc jewel case. The protective backing 12' will not allow moisture to drip through the spindle hole 16 of the compact disc 10 to a resting surface.

Figure 4A:
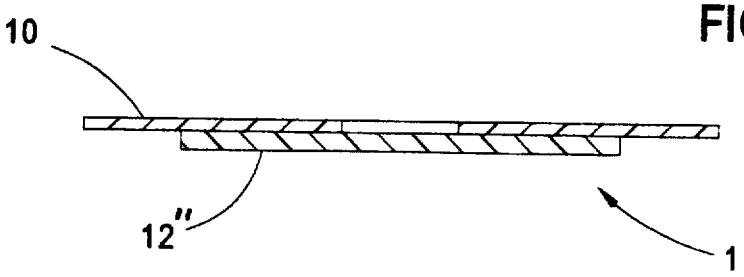
FIG. 4*a* is a cross sectional view of a first preferred embodiment of a compact disc drink coaster with a flexible protective backing before insertion of a spindle of a compact disc jewel case in accordance with the present invention.
Figure 4B:
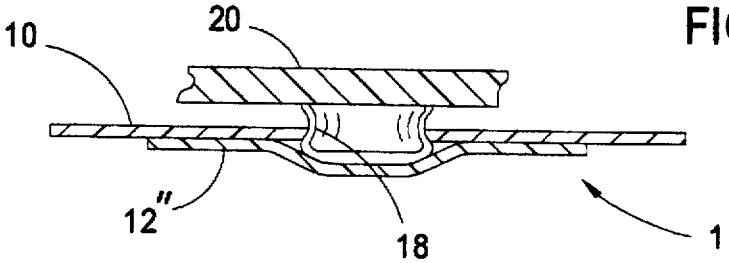
FIG. 4*b* is a cross sectional view of a first preferred embodiment of a compact disc drink coaster retained by a spindle of a compact disc case in accordance with the present invention.

FIG. 4*a* shows a protective backing 12" fabricated from any flexible material such as rubber, or close cell foam. The protective backing 12" is fastened to the compact disc 10 at substantially the circumference of the protective backing 12". In FIG. 4*b*, the spindle 18 of the compact disc jewel case 20 is inserted into the compact disc 10. The protective backing 12" is sufficiently flexible to stretch and accommodate the spindle 18 without the protective backing 12" detaching from the compact disc 10.

Figure 5A:
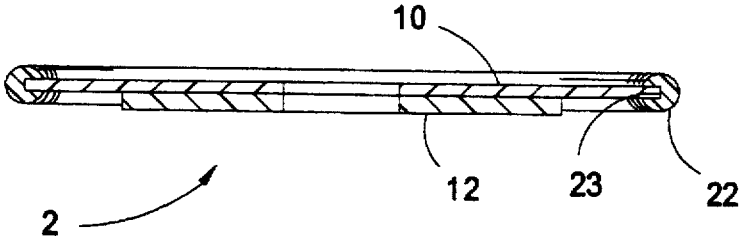
FIG. 5*a* is a cross sectional view of a second preferred embodiment of a compact disc drink coaster with an edge spill ring in accordance with the present invention.
Figure 5B:
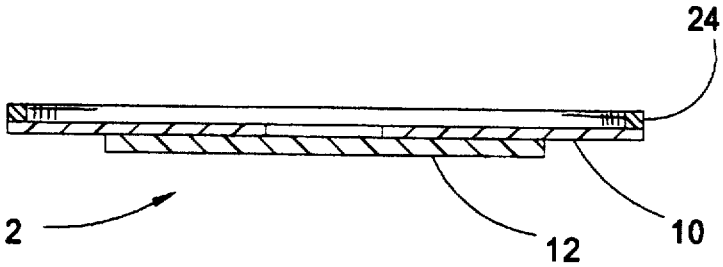
FIG. 5*b* is a cross sectional view of a second preferred embodiment of a compact disc drink coaster with a top edge spill retainer in accordance with the present invention.

FIG. 5*a* shows a cross sectional view of a second preferred embodiment of a compact disc drink coaster 2. The compact disc drink coaster 2 includes a compact disc 10, a protective backing 12, and an edge spill ring 22. The edge spill ring 22 has a edge groove 23 which is sized to be received by the outside perimeter of the compact disc 10. The edge spill ring 22 is fabricated from an elastic material and is stretched and snapped on to the outside circumference of the compact disc 10. The edge spill ring 22 prevents moisture from flowing over the outside circumference of the compact disc 10 on to a resting surface. In FIG. 5*b*, a top edge spill ring 24 is fastened to the top surface of the compact disc 10 at the outside circumference thereof. The top edge spill ring 24 prevents moisture from flowing over the compact disc 10. The large top surface of the compact disc may be easily printed with a design, name, or slogan. When the user is done with the compact disc drink coaster 2, thereof may be placed in a compact disc jewel case which may be stored in a compact disc storage device.

Figure 6:
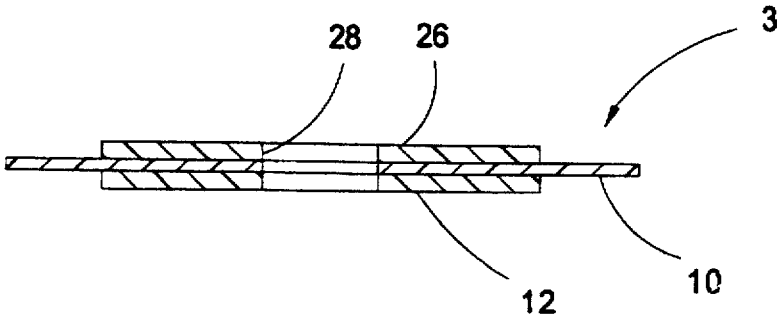
FIG. 6 is a cross sectional view of a third preferred embodiment of a compact disc drink coaster with a moisture absorbing surface in accordance with the present invention.

FIG. 6 shows a cross sectional view of a third preferred embodiment of a compact disc drink coaster 3. The compact disc drink coaster 3 includes a compact disc 10, a protective backing 12, and an absorbent pad 26. The absorbent pad 26 is fabricated from any absorbent material. A clearance hole 28 is formed in the center to allow insertion of a compact disc case spindle in to the compact disc 10. The absorbent pad 26 will absorb moisture from the bottom of a glass, can, or bottle. The outside diameter of the absorbent pad is sufficiently smaller than the outside circumference of the compact disc 10 such that some art work may be printed between the outside diameter of the absorbent pad 28 and the outside circumference of the compact disc 10. The protective backing 12 of the first preferred embodiment is also fastened to the back surface of the compact disc. When the user is done with the compact disc drink coaster 3 it may be placed in a compact disc jewel case which may be stored in a compact disc storage device.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A compact disc drink coaster comprising:

a compact disc; and a protective backing having a cavity which provides clearance for a spindle of a compact disc jewel case fastened to a back surface of said compact disc, wherein said protective backing protects a resting surface from scratches.

2. The compact disc drink coaster of claim 1 wherein:

said compact disc being discarded by a manufacturer of compact discs.

3. The compact disc drink coaster of claim 1 wherein:

said compact disc drink coaster being adapted to be retained and stored in a compact disc jewel case.

4. The compact disc drink coaster of claim 1 wherein:

said protective backing being fabricated from a flexible material, wherein said protective backing stretches sufficiently to receive a spindle of a compact disc jewel case without thereof detaching from said compact disc.

5. The compact disc drink coaster of claim 1, further comprising:

an edge spill ring having an edge-groove which is sized to receive an outside circumference of said compact disc, said edge spill ring being stretched and snapped over said outside perimeter of said compact disc.

6. The compact disc drink coaster of claim 1, further comprising:

a top edge spill ring being fastened to a top surface of said compact disc at an outside circumference thereof.

7. The compact disc drink coaster of claim 1, further comprising:

an absorbent pad being fastened to a top surface of said compact disc.

8. A compact disc drink coaster comprising:

a compact disc which has been discarded from a manufacturer of compact discs; and a protective backing having a cavity which provides clearance for a spindle of a compact disc jewel case fastened to a back surface of said compact disc, wherein said protective backing protects a resting surface from scratches.

9. The compact disc drink coaster of claim 8, further comprising:

an absorbent pad being fastened to a top surface of said compact disc.

10. The compact disc drink coaster of claim 8 wherein:

said compact disc drink coaster being adapted to be retained and stored in a compact disc jewel case.

11. The compact disc drink coaster of claim 8 wherein:

said protective backing being fabricated from a flexible material, wherein said protective backing stretches sufficiently to receive a spindle of a compact disc jewel case without detaching from said compact disc.

12. The compact disc drink coaster of claim 8, further comprising:

an edge spill ring having an edge groove which is sized to receive an outside circumference of said compact disc, said edge spill ring being stretched and snapped over said outside perimeter of said compact disc.

13. The compact disc drink coaster of claim 8, further comprising:

a top edge spill ring being fastened to a top surface of said compact disc at an outside circumference thereof.

14. A method for recycling a compact disc, comprising the steps of:

(a) fastening a protective backing having a cavity which provides clearance for a spindle of a compact disc jewel case to a discarded compact disc to form a compact disc drink coaster;

(b) placing said compact disc drink holder on a resting surface; and (c) placing a container of fluid on said compact disc to protect a resting surface from moisture damage.

* * * * *